US012063963B2

(12) United States Patent
Jung et al.

(10) Patent No.: US 12,063,963 B2
(45) Date of Patent: Aug. 20, 2024

(54) AEROSOL GENERATING ARTICLE

(71) Applicant: KT&G CORPORATION, Daejeon (KR)

(72) Inventors: Sun Hwan Jung, Daejeon (KR); Dong Kyun Ko, Sejong (KR); Eun Mi Jeoung, Daejeon (KR); Young Rim Han, Daejeon (KR); Kyung Hwan Oh, Daejeon (KR); Sung Jong Ki, Daejeon (KR); Sung Hoon Ha, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 721 days.

(21) Appl. No.: 17/254,598

(22) PCT Filed: Oct. 15, 2019

(86) PCT No.: PCT/KR2019/013484

§ 371 (c)(1),
(2) Date: Dec. 21, 2020

(87) PCT Pub. No.: WO2020/080783

PCT Pub. Date: Apr. 23, 2020

(65) Prior Publication Data

US 2021/0127741 A1 May 6, 2021

(30) Foreign Application Priority Data

Oct. 17, 2018 (KR) ..... 10-2018-0123921

(51) Int. Cl.
*A24F 40/40* (2020.01)
*A24D 3/02* (2006.01)
(Continued)

(52) U.S. Cl.
CPC ..... *A24F 40/40* (2020.01); *A24D 3/02* (2013.01); *A24D 3/048* (2013.01); *A24D 3/10* (2013.01)

(58) Field of Classification Search
CPC A24F 40/40; A24F 40/46; A24D 3/02; A24D 3/048; A24D 3/10; A24D 3/061;
(Continued)

(56) References Cited

U.S. PATENT DOCUMENTS 4,989,620 A * 2/1991 Keritsis ..... A24B 3/14 131/354
6,053,176 A 4/2000 Adams et al.
(Continued)

FOREIGN PATENT DOCUMENTS

CN 103355742 A 10/2013
CN 103989252 A 8/2014
(Continued)

OTHER PUBLICATIONS

Chinese Office Action dated Apr. 21, 2023 in Application No. 201980063777.3.
(Continued)

*Primary Examiner* — Alexander Gilman
(74) *Attorney, Agent, or Firm* — Sughrue Mion, PLLC

(57) ABSTRACT

Disclosed are an aerosol generating article and an aerosol generating device, wherein the aerosol generating article includes a tobacco rod and a cooling segment configured to cool aerosols generated from the tobacco rod through a tobacco composition.

11 Claims, 8 Drawing Sheets

(51) Int. Cl.
*A24D 3/04* (2006.01)
*A24D 3/10* (2006.01)

(58) Field of Classification Search
CPC ..... A24D 1/20; A24D 3/17; A24D 3/0279; A24D 3/0287; A24D 3/0291; A24D 3/04; A24B 15/12; A24B 3/14; A24B 3/18; A24C 5/1814; A24C 5/1885; A24C 5/22; A24C 5/54
USPC ..... 131/329
See application file for complete search history.

(56) References Cited

U.S. PATENT DOCUMENTS

| | | | | |
|---|---|---|---|---|
| 9,554,594 | B2 * | 1/2017 | Clark | A24D 3/061 |
| 10,729,171 | B2 | 8/2020 | Penrose et al. | |
| 2002/0056463 | A1 * | 5/2002 | Henning | A24D 3/043 131/331 |
| 2002/0056643 | A1 * | 5/2002 | Watanabe | C25D 1/02 205/73 |
| 2014/0305448 | A1 | 10/2014 | Zuber et al. | |
| 2015/0027474 | A1 | 1/2015 | Zuber et al. | |
| 2015/0313281 | A1 | 11/2015 | Bonici et al. | |
| 2016/0295926 | A1 * | 10/2016 | Zuber | A24F 42/10 |
| 2016/0309781 | A1 * | 10/2016 | Malgat | A24C 5/00 |
| 2016/0324216 | A1 * | 11/2016 | Li | A24F 40/30 |
| 2016/0331031 | A1 * | 11/2016 | Malgat | A24D 1/20 |
| 2016/0331032 | A1 * | 11/2016 | Malgat | A24B 3/14 |
| 2017/0086508 | A1 * | 3/2017 | Mironov | A24C 5/01 |
| 2018/0007971 | A1 * | 1/2018 | Plojoux | F22B 1/284 |
| 2018/0070641 | A1 * | 3/2018 | Batista | A61M 11/042 |
| 2018/0177222 | A1 * | 6/2018 | Emmett | B33Y 80/00 |
| 2018/0177233 | A1 * | 6/2018 | Tucker | A24F 40/30 |
| 2018/0177235 | A1 * | 6/2018 | Minzoni | A24D 1/20 |
| 2018/0235283 | A1 | 8/2018 | Zuber et al. | |
| 2018/0255827 | A1 * | 9/2018 | John | A24B 15/16 |
| 2019/0116874 | A1 * | 4/2019 | England | A24D 1/20 |
| 2019/0124981 | A1 * | 5/2019 | Fursa | A24F 40/46 |
| 2020/0093177 | A1 | 3/2020 | Han et al. | |
| 2020/0359681 | A1 * | 11/2020 | Han | A24F 40/53 |
| 2020/0359682 | A1 * | 11/2020 | Han | A24F 40/53 |

FOREIGN PATENT DOCUMENTS

| | | | |
|---|---|---|---|
| CN | 104203015 | A | 12/2014 |
| CN | 104449586 | A | 3/2015 |
| CN | 105072937 | A | 11/2015 |
| CN | 108158029 | A | 6/2018 |
| CN | 108433197 | A | 8/2018 |
| CN | 108593132 | A | 9/2018 |
| EP | 1 889 550 | A1 | 2/2008 |
| GB | 1277930 | A | 6/1972 |
| JP | 2014-518079 | A | 7/2014 |
| JP | 2015-508676 | A | 3/2015 |
| KR | 1987-0002096 | B1 | 9/1986 |
| KR | 2003-0093631 | A | 12/2003 |
| KR | 10-2018-0020136 | A | 2/2018 |
| KR | 10-2018-0070512 | A | 6/2018 |
| KR | 10-2018-0090897 | A | 8/2018 |
| WO | 2013/000967 | A1 | 1/2013 |
| WO | 2013/034306 | A1 | 3/2013 |
| WO | 2016/042100 | A1 | 3/2016 |
| WO | 2016/184929 | A1 | 11/2016 |
| WO | 2017/178394 | A1 | 10/2017 |
| WO | 2018/110834 | A2 | 6/2018 |

OTHER PUBLICATIONS

Office Action issued Feb. 1, 2022 in Japanese Application No. 2020-557968.
International Search Report for PCT/KR2019/013484 dated Jan. 22, 2020 [PCT/ISA/210].
Written Opinion for PCT/KR2019/013484 dated Jan. 22, 2020 [PCT/ISA/237].
Extended European Search Report dated Aug. 16, 2021 from the European Patent Office in EP Application No. 19872658.0.
Chinese Office Action dated Oct. 20, 2023 in Application No. 201980063777.3.
Office Action issued Feb. 6, 2024 in Chinese Application No. 201980063777.3.
Office Action issued Mar. 5, 2023 in Japanese Application No. 2022-192990.

* cited by examiner

AEROSOL GENERATING ARTICLE

TECHNICAL FIELD

The present disclosure relates to an aerosol generating article including a cooling segment.

BACKGROUND ART

Recently, the demand for alternative methods of overcoming the shortcomings of cigarettes, which is an example of an aerosol generating article, has increased. For example, there is an increasing demand for a method of generating an aerosol by heating an aerosol generating material in cigarettes, rather than by burning cigarettes.

A cigarette includes a filter, and the filter is configured to filter a certain component included in an aerosol or cool the aerosol. In the case of a polylactic acid (PLA) fiber cooling filter of the related art, the taste of a cigarette provided to a user decreases as the number of puffs of the user increases. In addition, in the case of the PLA fiber cooling filter of the related art, due to the characteristics of the PLA fiber, resistance of suction in smoking increases as the number of puffs increases, and heat of main-stream smoke and the surface of an aerosol generating article increases.

Accordingly, research is being conducted to improve the performance of a cooling filter by changing components constituting the cooling filter or changing the structure of the cooling filter.

DESCRIPTION OF EMBODIMENTS

Technical Problem

The present disclosure relates to an aerosol generating article. More particularly, the present disclosure relates to an aerosol generating article including a cooling segment.

Technical Solution to Problem

According to an aspect, an aerosol generating article in combination with an aerosol generating device may include a tobacco rod and a cooling segment located downstream of the tobacco rod and configured to cool aerosols generated from the tobacco rod through a tobacco composition.

Advantageous Effects of Disclosure

As described above, as a cooling segment in an aerosol generating article includes a tobacco composition, a tobacco taste may be continuously provided to a user until the latter half of smoking. In addition, when the cooling segment is located adjacently downstream of a tobacco rod, because a portion of heat applied to the tobacco rod may be transferred to a portion of the cooling segment, the tobacco taste may be long-lasting and an amount of aerosols may be increased. Accordingly, smoking satisfaction may be provided to a user throughout smoking. In addition, as the cooling segment includes the tobacco composition instead of a polylactic acid (PLA) fiber in the related art, problems, caused by the PLA fiber, such as an increase in resistance of suction in smoking, an increase in the temperature of main-stream smoke, and an increase in heat on the surface of an aerosol generating article, may be solved.

In addition, the cooling segment including the tobacco composition according to the present disclosure may have more effective aerosol cooling performance compared to a cooling segment including the PLA fiber in the related art.

BEST MODE

Figure 1:
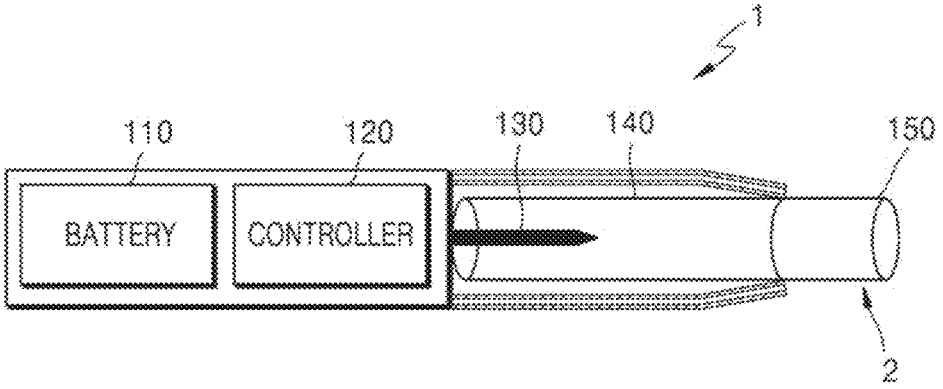
FIG. 1 is a diagram illustrating an example in which an aerosol generating article is inserted into an aerosol generating device.

According to an aspect, an aerosol generating article in combination with an aerosol generating device may include a tobacco rod and a cooling segment located downstream of the tobacco rod and configured to cool aerosols generated from the tobacco rod through a tobacco composition.

In addition, the tobacco rod may include a plurality of tobacco strands, and the cooling segment may include a reconstituted tobacco sheet.

In addition, the reconstituted tobacco sheet may have a shape rolled up in the cooling segment.

In addition, the reconstituted tobacco sheet may be wrinkled or folded according to at least one of a crimping operation, a pleating operation, a folding operation, and a gathering operation.

In addition, the tobacco composition of the cooling segment may include an aerosol generating material in an amount less than that of a tobacco composition in the tobacco rod.

In addition, each of the tobacco rod and the cooling segment may be separately manufactured and combined to each other.

In addition, the cooling segment may be located adjacent to the tobacco rod.

In addition, the cooling segment may form at least one channel in a longitudinal direction of the aerosol generating article.

In addition, the tobacco rod may have a length of about 7 mm to about 15 mm, and the cooling segment may have a length of about 10 mm to about 14 mm.

In addition, the cooling segment may have a surface area of about 5000 $mm^2$ to about 9000 $mm^2$.

In addition, the aerosol generating article may include a first filter segment having a tube shape located downstream of the cooling segment and including a hollow, a second filter segment, which is an acetate filter, located downstream of the first filter segment, and at least one wrapper packaged at least one of the tobacco rod, the cooling segment, the first filter segment, and the second filter segment.

According to another aspect, an aerosol generating device generating aerosols in combination with an aerosol generating article may include, a battery, and a heater configured to heat the aerosol generating article through electric power supplied from the battery, wherein the aerosol generating article may include a tobacco rod and a cooling segment located downstream of the tobacco rod and configured to cool aerosols generated from the tobacco rod through a tobacco composition.

MODE OF DISCLOSURE

With respect to the terms in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements.

In the following embodiments, when a user inhales air by using a smoking article, the portion from which air from the outside flows to the inside of an aerosol generating article is "upstream", and the portion from which air from the inside of the aerosol generating article flows to the outside is "downstream". The terms "upstream" and "downstream" are terms used to indicate the relative position or direction between segments configuring the aerosol generating article.

Hereinafter, the present disclosure will now be described more fully with reference to the accompanying drawings, in which exemplary embodiments of the present disclosure are shown such that one of ordinary skill in the art may easily work the present disclosure. The disclosure can, however, be embodied in many different forms and should not be construed as being limited to the embodiments set forth herein.

Hereinafter, embodiments of the present disclosure will be described in detail with reference to the drawings.

FIG. 1 is a diagram illustrating an example in which an aerosol generating article is inserted into an aerosol generating device.

Referring to FIG. 1, an aerosol generating article 2 may be inserted into an aerosol generating device 1 through an end of a case. When the aerosol generating article 2 is inserted, a heater 130 is located in the aerosol generating article 2. Accordingly, an aerosol generating material in the aerosol generating article 2 is heated by the heater 130, thereby generating aerosols.

Herein, the heater 130 is heated by electric power supplied from a battery 110 included in the aerosol generating device 1. When the aerosol generating article 2 is inserted into the aerosol generating device 1, the heater 130 is located inside the aerosol generating article 2. Accordingly, the heated heater 130 may increase the temperature of an aerosol generating material in the aerosol generating article 2. The heater 130 is illustrated as heating an interior of the aerosol generating article 2 with a heating element in a needle or rod shape, but is not limited thereto. For example, a heater in the aerosol generating device 1 may heat an exterior of the aerosol generating article 2 with a heating element in a tube shape or a plate shape.

A controller 120 generally controls operations of the aerosol generating device 1. In detail, the controller 120 controls not only operations of the battery 110 and the heater 130, but also operations of other components included in the aerosol generating device 1. In addition, the controller 120 may check a state of each of the components of the aerosol generating device 1 to determine whether or not the aerosol generating device 1 is able to operate.

The controller 120 includes at least one processor. A processor may be implemented as an array of a plurality of logic gates or may be implemented as a combination of a general-purpose microprocessor and a memory in which a program executable in the microprocessor is stored. It will be understood by one of ordinary skill in the art that the processor may be implemented in other forms of hardware.

The aerosol generating article 2 may be similar to a general combustion-type cigarette. For example, the aerosol generating article 2 may be divided into a first portion 140 including an aerosol generating material and a second portion 150 including a filter or the like. The aerosol generating article 2 according to an embodiment may also include an aerosol generating material in the second portion 150. For example, an aerosol generating material made in the form of granules or capsules may be inserted into the second portion 150.

The first portion 140 may be completely inserted into the aerosol generating device 1, and the second portion 150 may be exposed to the outside. Alternatively, only a portion of the first portion 140 may be inserted into the aerosol generating device 1, or a portion of the first portion 140 and a portion of the second portion 150 may be inserted thereinto.

A user may puff aerosol while holding the second portion 150 by the mouth of the user. At this time, the aerosol is mixed with external air and delivered to the users mouth. External air may be introduced through at least one hole formed in the surface of the aerosol generating article 2, or may be introduced through at least air passage formed in the aerosol generating device 1. For example, the air passage formed in the aerosol generating device 1 may be manufactured to be opened and closed by the user.

Figure 2A:
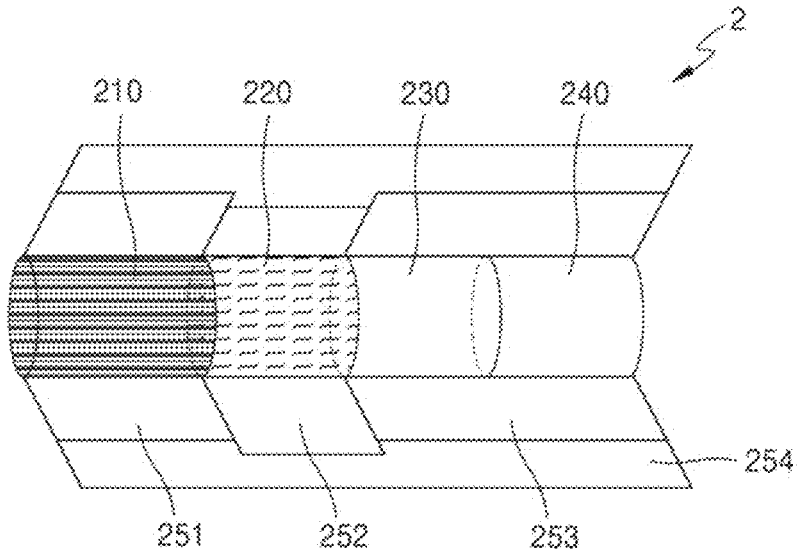
FIG. 2A is a structural diagram illustrating an example of an aerosol generating article.

FIG. 2A is a structural diagram illustrating an example of an aerosol generating article.

Referring to FIG. 2A, the aerosol generating article 2 may include a tobacco rod 210, a cooling segment 220, a first filter segment 230, a second filter segment 240, and wrappers 251 to 254. The first portion described above with reference to FIG. 1 may include the tobacco rod 210, and the second portion may include the cooling segment 220, the first filter segment 230, and the second filter segment 240. Alternatively, the first portion described above with reference to FIG. 1 may include at least a portion of the tobacco rod 210 and the cooling segment 220, and the second portion may include remaining components.

The structure of the aerosol generating article 2 illustrated in FIG. 2A is only an example, and some configurations may be omitted. For example, at least one of the first filter segment 230 and the second filter segment 240 may not be included in the aerosol generating article 2.

The tobacco rod 210 includes an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol. The length of the tobacco rod 210 may be about 7 mm to about 15 mm, or preferably about 14 mm. In addition, the diameter of the tobacco rod 210 may be about 7 mm to about 9 mm, or preferably, about 7.9 mm. The length and diameter of the tobacco rod 210 are not limited to the numerical range described above.

In addition, the tobacco rod 210 may include other additives, such as flavors, a wetting agent, and/or an acetate compound. For example, the flavors may include licorice, saccharose, fructose syrup, isosweet, cocoa, lavender, cinnamon, cardamon, celery, fenugreek, cascarilla, white sandalwood, *Monarda didyma*, geranium, honey essence, rose oil, vanilla, lemon oil, orange oil, mint oil, cinnamon, caraway, cognac, jasmine, chamomile, menthol, cinnamon, ylang-ylang, salvia, spearmint, ginger, coriander, coffee, or the like. In addition, the wetting agent may include glycerin, propylene glycol, or the like.

As another example, the tobacco rod 210 may be filled with tiny bits. Herein, the tiny bits may be generated by finely cutting a tobacco sheet.

An operation of allowing a tobacco sheet to be easily folded is additionally needed to fill a wide tobacco sheet in the tobacco rod 210 of a narrow space. Accordingly, compared to filling the tobacco rod 210 with a tobacco sheet, filling the tobacco rod 210 with tiny bits may be easier, and productivity and efficiency of an operation of generating the tobacco rod 210 may be higher.

As another example, the tobacco rod 210 may be filled with a plurality of tobacco strands in which a tobacco sheet is finely cut. For example, the tobacco rod 210 may be formed by combining a plurality of tobacco strands in the same direction (parallel) or randomly. One of the plurality of tobacco strands may be manufactured in a shape of a rectangular parallelepiped having a horizontal length of 1 mm, a vertical length of 12 mm, and a thickness (height) of 0.1 mm, but is not limited thereto.

As compared with the tobacco rod 210 being filled with a tobacco sheet, the tobacco rod 210 filled with tobacco strands may generate a greater amount of aerosol. Assuming the tobacco sheet and the tobacco strands are filled in the same space, the tobacco strands ensure a larger surface area, as compared with the tobacco sheet. A larger surface area means that an aerosol generating material has a greater chance of contacting external air. Accordingly, when the tobacco rod 210 is filled with tobacco strands, more aerosol may be generated that that filled with a tobacco sheet.

In addition, when separating the aerosol generating article 2 from the aerosol generating device 1, the tobacco rod 210 filled with tobacco strands may be separated more easily that that filled with a tobacco sheet. The friction force generated by tobacco strands in contact with the heater 130 is smaller than that of a tobacco sheet. Accordingly, when the tobacco rod 210 is filled with tobacco strands, the tobacco rod 210 is more easily separated from the aerosol generating device 1 compared to that filled with a tobacco sheet.

A tobacco sheet may be formed by grinding a tobacco raw material into a slurry and then drying the slurry. For example, about 15% to about 30% of the aerosol generating material may be added to the slurry. A tobacco raw material may include tobacco leaf pieces, tobacco stems, tobacco dust generated during tobacco processing, and/or a main side strip of a tobacco leaf. In addition, other additives, such as wood cellulose fibers, may be contained in a tobacco sheet.

Because the cooling segment 220 includes a tobacco composition, the cooling segment 220 may cool, through the tobacco composition, aerosol generated by heating the tobacco rod 210 by the heater 130. In other words, the cooling segment may include a tobacco composition as a cooling material. Accordingly, a user may puff aerosol which is cooled to an appropriate temperature.

In a case of a polylactic acid (PLA) fiber cooling segment, a tobacco taste provided to a user decreases as the number of puffs of the user increases. However, according to the present disclosure, as the cooling segment includes a tobacco composition, the tobacco taste may be continuously maintained until the latter half of smoking. In addition, as the cooling segment 220 is located adjacently downstream of the tobacco rod 210, the heater 130 may heat not only the tobacco rod 210 but also a portion of the cooling segment 220, or a portion of heat applied to the tobacco rod 210 may be transferred to a portion of the cooling segment 220, a tobacco taste may be continuously provided, and an amount of aerosol may be increased. Accordingly, smoking satisfaction due to the aerosol generating article 2 may be provided to a user throughout smoking. In addition, in a case of the PLA fiber cooling segment in the related art, due to the characteristic of the PLA fiber, resistance of suction in smoking increases as the number of puffs of a user increases, and a temperature of main-stream smoke and a surface of an aerosol generating article increases. However, the cooling segment according to the present disclosure may include a tobacco composition to solve the problems of the related art.

As the cooling segment 220 is located adjacently downstream of the tobacco rod 210, aerosol of the tobacco rod 210 may be initially cooled, and the first filter segment 230 or the second filter segment 240 located downstream thereof may be prevented from deformation. In addition, in a case of an aerosol generating article in the related art, as a support element is located adjacently downstream of a tobacco rod, heat is transferred to the support element to melt the support element, and a smoking flavor deteriorates due to a smell generated by melting of the support element. However, according to the present disclosure, as the cooling segment 220 is located adjacently downstream of the tobacco rod 210, the above problem may be solved.

The cooling segment 220 may include a tobacco sheet. For example, the cooling segment 220 may include a reconstituted tobacco sheet. The tobacco sheet may be formed by grinding a tobacco raw material into a slurry and then drying the slurry, but is not limited thereto. For example, a tobacco sheet may be formed according to a paper-making method or a rolling method. A tobacco raw material may include tobacco leaf pieces, tobacco stems, tobacco dust generated during tobacco processing, and/or a main side strip of a tobacco leaf. In addition, other additives, such as wood cellulose fibers, may be contained in a tobacco sheet.

According to an embodiment, the tobacco rod 210 may be manufactured through an operation in which various types of tobacco leaf processed products, a moisturizer, moisture, and other additives are mixed and then cut to a a constant length and width, and the cooling segment 220 may also be manufactured by using the same materials as the tobacco rod 210, but the cutting operation is not performed and a filter manufacturing operation by using a sheet-type material is performed, and material components such as a moisturizer, moisture, or the like may be different from that of the tobacco rod 210. In detail, the tobacco sheet of the cooling segment 220 may include stems, leaf stalks, ligules, tiny bits, or the like as a raw material, and the tobacco sheet may be manufactured through an operation of separating fiber/extract and an operation such as pressing/drying/coating or the like after an operation of injecting a mixture of sub-materials to form a sheet. In addition, the tobacco sheet may be flavored to mask off a smell or the like during the above-described operations, but flavoring materials related to tobacco smell may be not contained.

According to an embodiment, unlike the tobacco sheet of the tobacco rod 210, an aerosol generating material may not be added to the tobacco sheet of the cooling segment 220.

For example, although about 15% to about 30% of an aerosol generating material may be added to a slurry used for manufacturing the tobacco sheet of the tobacco rod 210, an aerosol generating material may not be added to a slurry used for manufacturing the tobacco sheet of the cooling segment 220. According to another embodiment, an aerosol generating material in an amount equal to or less than that of the tobacco rod 210 may be added to the tobacco sheet of the cooling segment 220. In addition, unlike the tobacco sheet of the tobacco rod 210, additives, such as flavors, flavoring materials, or the like, may not be added to the tobacco sheet of the cooling segment 220.

The tobacco sheet in the cooling segment 220 may have a rolled shape. In other words, the tobacco sheet may be rolled up in a roll-like shape. In addition, the tobacco sheet in the cooling segment 220 may be wrinkled or folded according to at least one of a crimping operation, a pleating operation, a folding operation, and a gathering operation. In detail, the crimping operation is an operation in which creep is given to the surface of the sheet through a difference in pressure and speed of rollers of a crimping machine, and is divided into a wet operation and a dry operation. The wet operation refers to an operation in which a base paper is wetted in water and softened to be crimped and then dried again. The dry operation refers to a dry operation by two dryers having different temperatures. The pleating operation, the folding operation, and the gathering operation refers to an operation of compressing the tobacco sheet in the cooling segment 220 in a lateral direction of a cylindrical axis of the aerosol generating article 2 to form randomly oriented channels. In addition, the pleating operation, the folding operation, and the gathering operation means an operation in which a sheet inputted from a filter manufacturing device randomly forms a channel through a guide, and the pleating operation, the folding operation, the gathering operation, or the like may be classified depending on the shape or quantity of the guide.

The cooling segment 220 may be filled with tobacco strands or pipe tobaccos. Herein, the tobacco strands or the pipe tobaccos may be produced by grinding a tobacco sheet.

The cooling segment 220 may form at least one channel in a longitudinal direction of the aerosol generating article 2. The at least one channel function as a passage through which aerosol may pass. In addition, as the tobacco sheet is folded or rolled in the cooling segment 220, the cooling segment 220 may form channels of different shapes. The channel included in the cooling segment 220 is not limited to the longitudinal direction of the aerosol generating article 2, and may be formed in a direction perpendicular to the longitudinal direction of the aerosol generating article 2, or may be randomly oriented. In addition, the cooling segment 220 may be manufactured in various shapes to increase a surface area per unit area (that is, a surface area in contact with aerosol).

The diameter of channel may be variously determined according to a production operation of the cooling segment 220. In addition, uniform channels are distributed in the cooling segment 220. In other words, the cooling segment 220 may be manufactured such that channels are uniformly distributed over all cross sections. Accordingly, the cooling segment 220 may facilitate the flow of aerosol through the cooling segment 220.

The diameter of the cooling segment 220 may be about 5 mm to about 10 mm, or preferably about 7 mm. In addition, the length of the cooling segment 220 may be about 7 mm to about 28 mm, or preferably about 14 mm. In addition, the total surface area of the cooling segment 220 may be about 5000 $mm^2$ to about 9000 $mm^2$. Further, the air porosity of the cooling segment 220 may be about 10% to about 90%, or preferably about 60% to about 90%. That is, the ratio of the area through which aerosol may pass to the cross-sectional area of the cooling segment 220 may be about 10% to about 90%. In addition, the cooling segment 220 has an air porosity of 50% or less, such that a contact time and a contact area between aerosol and a tobacco composition may be increased. In other words, the cooling efficiency of the cooling segment 220 may be improved. In addition, the cooling segment 220 having the air porosity of 50% or less has an appropriate resistance of suction in smoking, such that a phenomenon of a wasteful inhalation due to low suction resistance in smoking may be prevented when a user inhales the aerosol generating article 2. The length, surface area, and air porosity of the cooling segment 220 are not limited to the above numerical ranges.

In addition, the cooling segment 220 may include a tobacco sheet, and the tobacco sheet may have a width of about 110 mm to about 130 mm and a thickness within 200 um. In addition, the tobacco sheet may have a basis weight of about 150 $g/m^2$ to about 190 $g/m^2$, and preferably may have about 170 $g/m^2$.

The first filter segment 230 may include a cellulose acetate filter. For example, the first filter segment 230 may have a tube shape including a hollow inside. The length of the first filter segment 230 may be about 7 mm to about 15 mm, or preferably about 7 mm. The length of the first filter segment 230 may be less than about 7 mm, but preferably has a length such that at least one cigarette element (for example, a cooling element, a capsule, an acetate filter, or the like) is not damaged. The length of the first filter segment 230 is not limited to the above-described numerical range. The length of the first filter segment 230 is expandable, and the total length of the aerosol generating article 2 may be adjusted according to the length of the first filter segment 230.

The second filter segment 240 may include a cellulose acetate filter. For example, the second filter segment 240 may be manufactured as a recess filter including a hollow, but is not limited thereto. The length of the second filter segment 240 may be about 5 mm to about 15 mm, or preferably about 12 mm. The length of the second filter segment 240 is not limited to the above-described numerical range.

In addition, at least one capsule may be included in the second filter segment 240. Herein, the at least one capsule may have a structure in which a solution including a flavoring material is wrapped with a film. For example, the at least one capsule may have a spherical or cylindrical shape. The diameter of the at least one capsule may be 2 mm or more, or preferably about 2 mm to about 4 mm.

A material forming the film of the at least one capsule may include starch and/or a gelling agent. For example, a gellan gum or gelatin may be used as the gelling agent. In addition, a gelling aid may be further used as a material forming the film of the at least one capsule. Herein, for example, calcium chloride may be used as the gelling aid. In addition, a plasticizer may be further used as a material forming the film of the at least one capsule. Herein, glycerin and/or sorbitol may be used as the plasticizer. In addition, a pigmenting material may be further used as a material forming the film of the at least one capsule.

For example, menthol, essential oils of plants, or the like may be used as a flavoring material included in the solution of the at least one capsule. In addition, for example, medium-chain triglyceride (MCT) may be used as a solvent of a flavoring material included in the content liquid. Further, the solution may include other additives, such as a pigment, an emulsifier, a thickener, or the like.

The tobacco rod 210 may be packaged via a first wrapper 251, and the cooling segment 220 may be packaged via a second wrapper 252. For example, each of the first wrapper 251 and the second wrapper 252 may be manufactured by a paper packaging material having oil resistance. In addition, the tobacco rod 210 and the cooling segment 220 may be packaged via one wrapper.

The first wrapper 251 and the second wrapper 252 may be produced by applying (or coating) a certain material on one surface or both surfaces of the paper packaging material. Herein, silicon may be used as an example of the certain material, but is not limited thereto. Silicon has characteristics such as heat resistance with little change with temperature, oxidation resistance that does not oxidize, resistance to various drugs, water repellency, electrical insulation, or the like. However, even when silicon is not used, any material having the above-described characteristics may be applied (or coated) to the first wrapper 251 or the second wrapper 252 with limitation.

The first wrapper 251 or the second wrapper 252 may prevent the aerosol generating article 2 from burning. For example, when the tobacco rod 210 is heated by the heater 130, the aerosol generating article 2 may be burned. In detail, when the temperature rises above the ignition point of any one of materials included in the tobacco rod 210, the aerosol generating article 2 may be burnt. In this case, because the first wrapper 251 or the second wrapper 252 includes a non-combustible material, burning of the aerosol generating article 2 may be prevented.

In addition, the first wrapper 251 or the second wrapper 252 may prevent the aerosol generating article 2 from being contaminated by materials generated in the aerosol generating article 2. Liquid materials may be generated in the aerosol generating article 2 by a user's puff. For example, liquid materials (for example, moisture, or the like) may be generated by cooling aerosol generated in the aerosol generating article 2 by external air. As the first wrapper 251 or the second wrapper 252 packages the tobacco rod 210 and/or the cooling segment 220, the liquid materials generated in the aerosol generating article 2 may be prevented from being leaked out from the aerosol generating article 2. Accordingly, a phenomenon, in which a case or the like of the aerosol generating device 1 is contaminated by the liquid materials generated in the aerosol generating article 2, may be prevented.

The first filter segment 230 and the second filter segment 240 may be packaged via a third wrapper 253. As another example, each of the first filter segment 230 and the second filter segment 240 may be packaged by a separate wrapper. In addition, the entire aerosol generating article 2 may be repackaged via a fourth wrapper 254. For example, the third wrapper 253 and the fourth wrapper 254 may be manufactured by a general paper packaging material. Optionally, the third wrapper 253 may be an oil-resistant hard rolled paper or a PLA flavored paper.

Figure 2B:
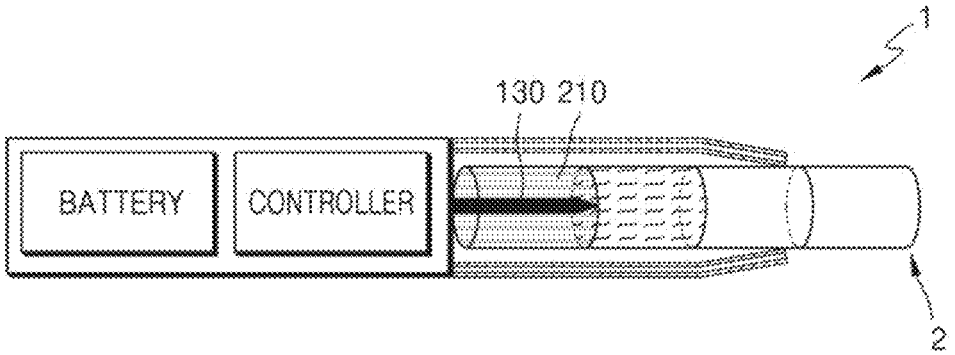
FIG. 2B is a diagram illustrating another example in which an aerosol generating article is inserted into an aerosol generating device.

FIG. 2B is a diagram illustrating another example in which an aerosol generating article is inserted into an aerosol generating device.

Referring to FIG. 2B, the aerosol generating article 2 of FIG. 2A may be inserted into the aerosol generating device 1 of FIG. 1. When the aerosol generating article 2 is inserted, the heater 130 may be located in the tobacco rod 210 of the aerosol generating article 2. In other words, the aerosol generating device 1 may generate aerosol by only heating the tobacco rod 210.

Figure 3A:
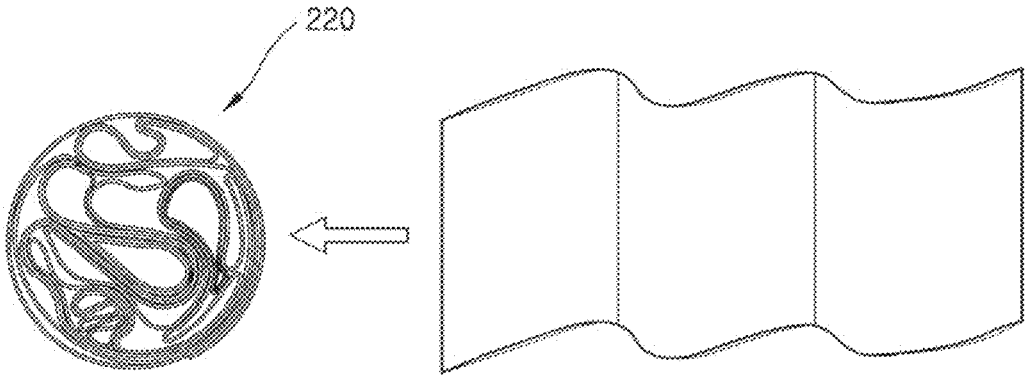
FIGS. 3A to 3C are diagrams illustrating examples of a cooling segment.
Figure 3B:
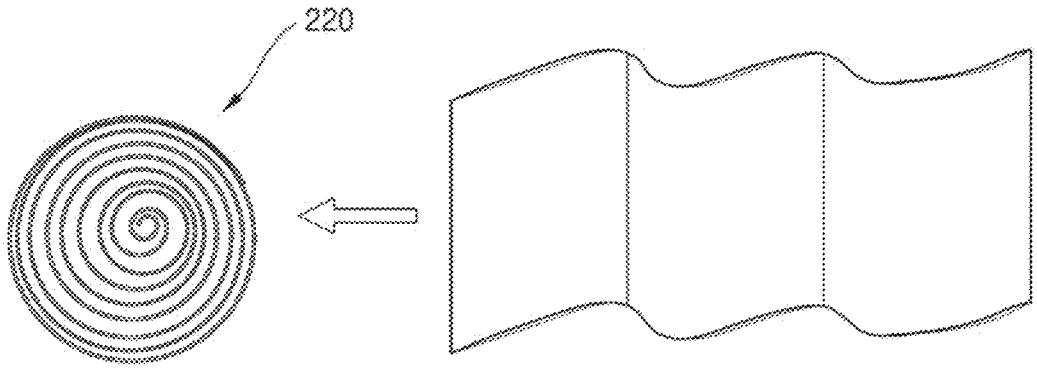
Figure 3C:
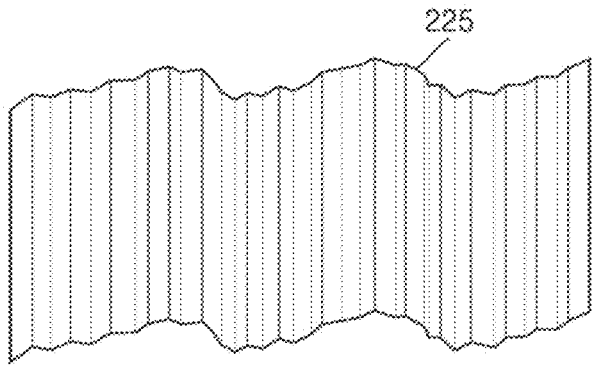

FIGS. 3A to 3C are diagrams illustrating examples of a cooling segment.

FIGS. 3A and 3B illustrate cross-sections of the cooling segment 220, and illustrate the cooling segment 220 including a reconstituted tobacco sheet. The reconstituted tobacco sheet may be folded or rolled to be filled in the cooling segment 220 of a narrow space. Accordingly, when manufacturing the cooling segment 220, an operation allowing the reconstituted tobacco sheet to be easily folded or rolled may be additionally needed.

Referring to FIG. 3A, as the reconstituted tobacco sheet is irregularly folded or rolled in the cooling segment 220, spaces and structures of a plurality of channels in the cooling segment 220 may be irregularly formed. However, according to another embodiment, the reconstituted tobacco sheet in the cooling segment 220 may be regularly folded or rolled to regularly form the spaces or structures of the plurality of channels in the cooling segment 220.

Referring to FIG. 3B, the reconstituted tobacco sheet in the cooling segment 220 may have a rolled shape such as a roll, and accordingly, a channel in the cooling segment 220 may be formed.

In FIGS. 3A and 3B, the reconstituted tobacco sheet of the cooling segment 220 is illustrated to be folded or rolled, but is not limited thereto. The reconstituted tobacco sheet may be folded or rolled into a wrinkled state and then filled into the cooling segment 220. In this case, the reconstituted tobacco sheet may be wrinkled according at least one of a crimping operation, a pleating operation, a folding operation, a gathering operation, before an operation of causing the reconstituted tobacco sheet to be folded.

FIG. 3C is a diagram illustrating an example of a reconstituted tobacco sheet 225 in the cooling segment 220. Referring to FIG. 3C, the reconstituted tobacco sheet 225 may have a wrinkled state according to at least one of a crimping operation, a pleating operation, a folding operation, and a gathering operation. According to an embodiment, the reconstituted tobacco sheet 225 may be folded or rolled as shown in FIGS. 3A and 3B in a wrinkled state and then filled in the cooling segment 220.

Figure 4:
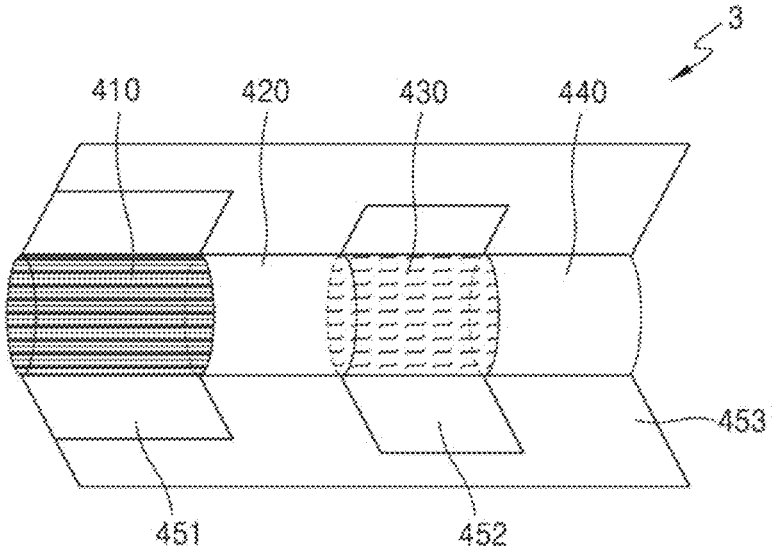
FIG. 4 is a structural diagram illustrating another example of an aerosol generating article.

FIG. 4 is a structural diagram illustrating another example of an aerosol generating article.

Referring to FIG. 4, an aerosol generating article 3 may include a tobacco rod 410, a first filter segment 420, a cooling segment 430, a second filter segment 440, and wrappers 451 to 454.

The tobacco rod 410, the first filter segment 420, the cooling segment 430, and the second filter segment 440 may correspond to the tobacco rod 210, the first filter segment 230, the cooling segment 220, the second filter segment 240 of FIG. 2A, and redundant descriptions thereof will be omitted. In addition, a first wrapper 451, a second wrapper 452, and a third wrapper 453 may correspond to the first wrapper 251, the second wrapper 252, and the fourth wrapper 253 of FIG. 2A, and redundant descriptions thereof will be omitted.

FIG. 2A illustrates that the cooling segment 220 is located downstream of the tobacco rod 210 and the first filter segment 230 is located downstream of the cooling segment 220, but FIG. 4 is different from FIG. 2 in that the first filter segment 420 is located downstream of the tobacco rod 410 and the cooling segment 430 is located downstream of the first filter segment 420.

The cooling segment 430 may cool aerosol that has passed through the first filter segment 420 through a tobacco composition.

Figure 5:
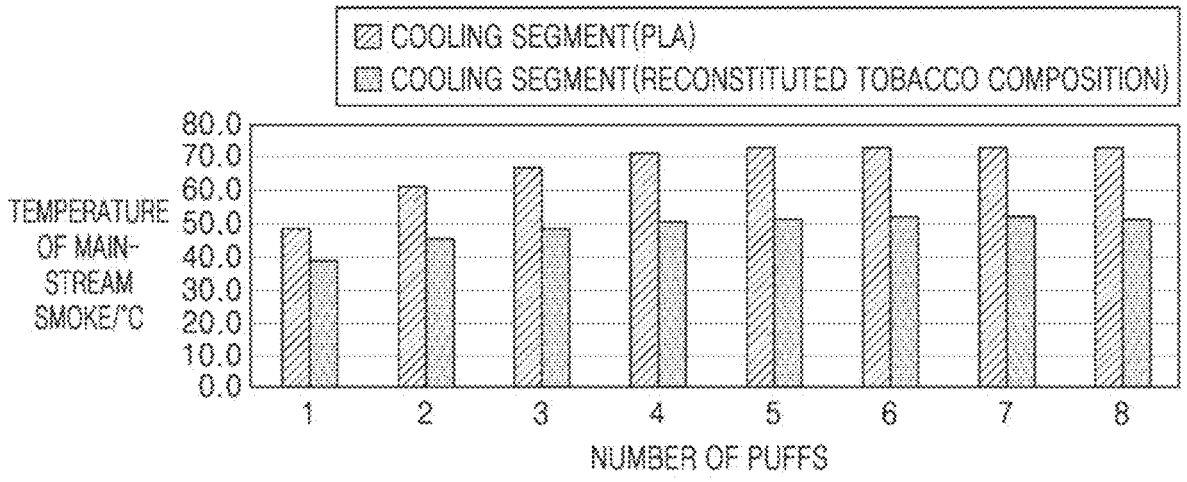
FIG. 5 is a diagram illustrating an example of an aerosol cooling effect of an aerosol generating article.

FIG. 5 is a diagram illustrating an example of an aerosol cooling effect of an aerosol generating article.

FIG. 5 shows the cooling effect of an aerosol generating article of the present disclosure using a reconstituted tobacco composition as a cooling material by comparing with an aerosol generating article in the related art using the PLA fiber as a cooling material. In other words, FIG. 5 shows a graph comparing the temperature of main-stream smoke for each puff generated from the aerosol generating article in the related art with the temperature of main-stream smoke for each puff generated from the aerosol generating article of the present disclosure.

Referring to the graph of FIG. 5, the aerosol generating article of the present disclosure having a more effective aerosol cooling performance than that of the aerosol generating article in the related art may be confirmed. In detail, at the temperature for each puff, the temperature of the main-stream smoke of the aerosol generating article of the present disclosure may be confirmed to be about 10 degrees to 20 degrees lower than the temperature of the main-stream smoke of the aerosol generating article in the related art. That is, the temperature of the main-stream smoke provided to a user through a cooling segment may be confirmed to be lower in the aerosol generating article of the present disclosure than in the aerosol generating article in the related art, even when an initial temperature generated in a tobacco rod is the same in each of the aerosol generating article in the related art and the aerosol generating article of the present disclosure. Accordingly, a cooling segment including a tobacco composition in the aerosol generating article of the present disclosure may be a more effective cooling material than a cooling segment including polylactic acid.

In addition, referring to the graph of FIG. 5, the temperature of the main-stream smoke of the aerosol generating article in the related art is seen to be increased as the number of puffs increases. However, the temperature of the main-stream smoke of the aerosol generating article of the present disclosure may be confirmed as being maintained almost unchanged even when the number of puffs increases. Accordingly, the cooling segment including the tobacco composition in the aerosol generating article of the present disclosure may have a cooling effect unchanged even when the number of puffs increases, unlike the cooling segment including polylactic acid.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol generating article which generates aerosols in combination with an aerosol generating device, the aerosol generating article comprising:

a tobacco rod comprising a first tobacco composition; and a cooling segment comprising a second tobacco composition, located downstream of the tobacco rod, and configured to cool aerosols generated from the tobacco rod through the second tobacco composition, wherein the second tobacco composition of the cooling segment comprises an added aerosol generating material in an amount that is greater than zero and that is less than an aerosol generating material of the first tobacco composition of the tobacco rod.

2. The aerosol generating article of claim 1, wherein the tobacco rod comprises a plurality of tobacco strands, and the cooling segment comprises a reconstituted tobacco sheet.

3. The aerosol generating article of claim 2, wherein the reconstituted tobacco sheet has a rolled up form within the cooling segment.

4. The aerosol generating article of claim 2, wherein the reconstituted tobacco sheet is wrinkled or folded according to at least one of a crimping operation, a pleating operation, a folding operation, and a gathering operation.

5. The aerosol generating article of claim 1, wherein each of the tobacco rod and the cooling segment are separately manufactured and combined with each other.

6. The aerosol generating article of claim 1, wherein the cooling segment is located adjacent to the tobacco rod.

7. The aerosol generating article of claim 1, wherein the cooling segment forms at least one channel in a longitudinal direction of the aerosol generating article.

8. The aerosol generating article of claim 1, wherein the tobacco rod has a length of about 7 mm to about 15 mm, and the cooling segment has a length of about 10 mm to about 14 mm.

9. The aerosol generating article of claim 1, wherein the cooling segment has a surface area of about 5000 mm2 to about 9000 mm2.

10. The aerosol generating article of claim 1, further comprising:

a first filter segment having a tube shape located downstream of the cooling segment and comprising a hollow;

a second filter segment, which is an acetate filter, located downstream of the first filter segment; and at least one wrapper wrapping at least one of the tobacco rod, the cooling segment, the first filter segment, and the second filter segment.

11. An aerosol generating device which generates aerosols in combination with an aerosol generating article, the aerosol generating device comprising:

a battery; and a heater configured to heat the aerosol generating article through electric power supplied from the battery, wherein the aerosol generating article comprises a tobacco rod comprising a first tobacco composition; and a cooling segment comprising a second tobacco composition, located downstream of the tobacco rod, and configured to cool aerosols generated from the tobacco rod through the second tobacco composition, wherein the second tobacco composition of the cooling segment comprises an added aerosol generating material in an amount that greater than zero and that is less than an aerosol generating material of the first tobacco composition of the tobacco rod.

* * * * *